US010760457B2

(12) United States Patent
Lee et al.

(10) Patent No.: US 10,760,457 B2
(45) Date of Patent: Sep. 1, 2020

(54) FAST ENGINE OIL WARM-UP TYPE OIL PAN AND ENGINE SYSTEM THEREOF

(71) Applicants: HYUNDAI MOTOR COMPANY, Seoul (KR); KIA MOTORS CORPORATION, Seoul (KR)

(72) Inventors: Byung-Hyun Lee, Bucheon-si (KR); Hyun-Jun Kim, Seoul (KR); Jung-Ho Joo, Gunpo-si (KR); Joon-Ho Park, Anyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/202,564

(22) Filed: Nov. 28, 2018

(65) Prior Publication Data

US 2019/0178121 A1 Jun. 13, 2019

(30) Foreign Application Priority Data

Dec. 8, 2017 (KR) ..... 10-2017-0168055

(51) Int. Cl.

| | |
|---|---|
| ***F01M 11/04*** | (2006.01) |
| ***F01M 11/00*** | (2006.01) |
| ***F01M 11/12*** | (2006.01) |
| *F01M 5/02* | (2006.01) |

(52) U.S. Cl.

CPC ..... *F01M 11/0004* (2013.01); *F01M 11/12* (2013.01); *F01M 2005/023* (2013.01); *F01M 2011/0025* (2013.01); *F01M 2011/0037* (2013.01); *F01M 2011/0045* (2013.01); *F01M 2011/0066* (2013.01); *F01M 2011/0087* (2013.01); *F01M 2011/0091* (2013.01)

(58) Field of Classification Search

CPC ..... F01M 11/0004; F01M 11/03; F01M 2011/0037; F01M 2011/0087; F01M 2011/0091; F01M 2005/023; F01M 2011/0029

See application file for complete search history.

(56) References Cited

U.S. PATENT DOCUMENTS

| | | | | |
|---|---|---|---|---|
| 6,845,743 | B1 * | 1/2005 | Bishop | F01M 11/0004 123/195 C |
| 9,534,520 | B2 * | 1/2017 | Mordukhovich | F01M 11/0004 |
| 2010/0162988 | A1 * | 7/2010 | Enokida | F01M 11/0004 123/195 C |
| 2010/0199942 | A1 * | 8/2010 | Yamada | F01M 11/0004 123/196 R |
| 2016/0003112 | A1 * | 1/2016 | Fukuoka | F01M 11/0004 123/196 A |
| 2019/0072015 | A1 * | 3/2019 | Hutchins | F01M 11/0004 |

FOREIGN PATENT DOCUMENTS

KR 10-2010-0129132 12/2010

* cited by examiner

*Primary Examiner* — Long T Tran
(74) *Attorney, Agent, or Firm* — Brinks Gilson & Lione

(57) ABSTRACT

An oil pan may include a pan body forming a dual chamber including a primary chamber and a secondary chamber, and a mesh. The primary chamber and the secondary chamber each contains a different amount of oil, and the mesh allows a different amount of oil permeation discharged from the secondary chamber to the primary chamber based on temperature of the oil.

17 Claims, 8 Drawing Sheets

| OIL TEMP. | OIL QUANTITY (1,000ml) | | | | REMARK |
|---|---|---|---|---|---|
| | 150μm MESH | | MESH | | |
| | DRAIN | NON DRAIN | DRAIN | NON DRAIN | |
| ROOM TEMPERATURE | A | a | | | |
| 60° | B | b | | | |
| 80° | D | d | | | |
| 100° | E | e | | | |

FAST ENGINE OIL WARM-UP TYPE OIL PAN AND ENGINE SYSTEM THEREOF

CROSS-REFERENCE TO RELATED APPLICATION

This application claims priority to and the benefit of Korean Patent Application No. 10-2017-0168055, filed on Dec. 8, 2017, the entire contents of which are incorporated herein by reference.

FIELD

The present disclosure relates to an oil pan, and more particularly, an engine system applied with the oil pan for fast engine oil warm-up.

BACKGROUND

The statements in this section merely provide background information related to the present disclosure and may not constitute prior art.

In general, an internal combustion engine of a vehicle generates the reciprocal motion of a piston and the rotation motion of a crankshaft, so that the lubrication for the sliding surface of the moving system is required, and for this purpose, oil circulating in the engine should be provided. An oil pan is provided to store the oil.

In one form, the oil pan consists of an oil chamber which forms the inner space where the oil flowing at a certain flow rate according to the engine specification is stored, an oil pump pumping the internal oil, and a heater to heat the oil.

Therefore, the oil pan forms an oil circulation in which the oil is returned after lubricating the friction sliding surface of the engine by the operation of the oil pump, and particularly, in cold start condition of the engine, the heater raises the oil temperature to a certain level.

However, heating the entire oil in the oil chamber delays the engine oil warm-up time to reach a the desired level.

This is disadvantageous to the friction fuel efficiency of the engine in the cold start condition and CO2 emission reduction, and also causes difficulties in meeting the regulation reinforcement of the worldwide harmonized light vehicles test procedure (WLTP) in the environmental market and fuel efficiency/EM (emission) by the real driving emission (RDE).

We have discovered that in order to improve the engine friction efficiency during cold starting and starting operation of the engine, it is desired to accelerate the preheating of the engine oil, and improvement of the performance of the oil pan.

The foregoing is intended merely to aid in the understanding of the background of the present disclosure, and is not intended to mean that the present disclosure falls within the purview of the related art that is already known to those skilled in the art.

SUMMARY

In view of the above matters, the present disclosure provides a fast engine oil warm-up type oil pan and an engine system thereof capable of preheating acceleration to improve engine oil warm-up efficiency under cold start operation by quickly supplying the engine oil in one compartment when engine oil is below a certain temperature, and particularly, increasing design freedom by separating the preheating accelerated oil flow using the compartment space by a dual chamber.

An oil pan, in one form of the present disclosure, may include: a pan body configured to form a primary chamber and a secondary chamber which are configured to contain a different amount of oil, respectively; and a mesh configured to differentiate an amount of oil permeation discharged from the secondary chamber to the primary chamber based on temperature of the oil.

As an one exemplary form, the pan body may be made of plastic. The oil temperature at which the amount of oil permeation is low may be a cold starting condition of an engine to which the oil is supplied. A capacity of the secondary chamber may be in a range from 30% to 40% compared to a capacity of the primary chamber. The mesh may be made of steel mesh and configured to adjust the amount of oil permeation by a mesh density of micrometer (μm) to be provided on a bottom surface of the secondary chamber.

As an another exemplary form, the pan body may include: a main chamber case forming the primary chamber and a sub-chamber case forming the secondary chamber; and the sub-chamber case is coupled to the main chamber case. The main chamber case is coupled with the sub-chamber case by fusing the sub-chamber case to sub-chamber ribs formed at the main chamber case.

In one form, a plurality of oil drop holes spaced apart from each other and an oil exchange hole are formed on the sub-chamber case and arranged at right angles to each other. In addition, a safety hole may be opened toward the same direction as the oil exchange hole is opened, and the safety hole and oil exchange hole are spaced apart from each other. The mesh may be coupled to each of the oil drop hole and the oil exchange hole.

As an one exemplary form, an oil pump for pumping the oil is provided at the pan body.

In other form, a pan cover may be coupled to the pan body to block external exposure of the primary chamber and the secondary chamber.

In another exemplary form, a heater, which makes the oil of the secondary chamber to be flowed into an inner space thereof at oil temperature of the low permeation amount and heats the oil flowed into the inner space, may be further include. The heater may be provided in the secondary chamber to form the inner space in which the oil of the secondary chamber is gathered, and may heat the oil through a heating element provided in the inner space thereof. A sub-chamber valve may be provided at the pan body, and the inner spaces of the secondary chamber and the heater may be communicated or blocked by the operation of the sub-chamber valve. The oil pump may be positioned at the heater side to pump the oil.

An engine system of the present disclosure may include an oil pan configured to store oil, and the oil pan includes: a pan body forming a dual chamber having a primary chamber formed by a main chamber case and a secondary chamber formed by a sub-chamber case; a mesh provided at an oil drop hole of the sub-chamber case to differ an amount of the permeation discharged from the primary chamber to the secondary chamber based on temperature of the oil; and an oil pump pumping the oil to circulate the oil in an engine.

As an one exemplary form, the oil pan may be made of plastic and located at a lower portion of the engine.

As an another exemplary form, the engine system may further include a heater installed in the oil pan to heat the flowed into oil from the primary chamber to convert the tempered oil at low oil temperature of the low oil permeation amount, and an ECU for operating the heater such that the fast engine oil warm-up is performed to the tempered oil under the cold starting condition of the engine.

The engine system of the present disclosure to which the fast engine oil warm-up type oil pan is applied, realizes the following actions and effects through the fast engine oil warm-up in cold and initial starting operation.

Firstly, as the engine oil warm-up time gets faster, the friction improvement effect on the moving system of the engine becomes higher.

Secondly, the preheating acceleration of the engine oil further improves the effect of improving the friction fuel efficiency by decreasing the heat loss and increasing the warming effect.

Thirdly, improvement in friction fuel efficiency reduces NOx and CO2 exhaust during the cold starting and initial starting of the engine, thereby meeting WLTP and RDE fuel efficiency/EM regulations and responding the increased environmental consciousness.

Fourthly, due to the divided space of a dual chamber, preheating acceleration oil flow rate is divided, so that it is possible to vary preheating acceleration oil flow rate of the oil pan according to engine specification, thereby realizing high degree of freedom of design.

Fifthly, the oil pan is made of plastic, so it is easy to realize insulation effect and complex shape compared to steel or aluminum.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
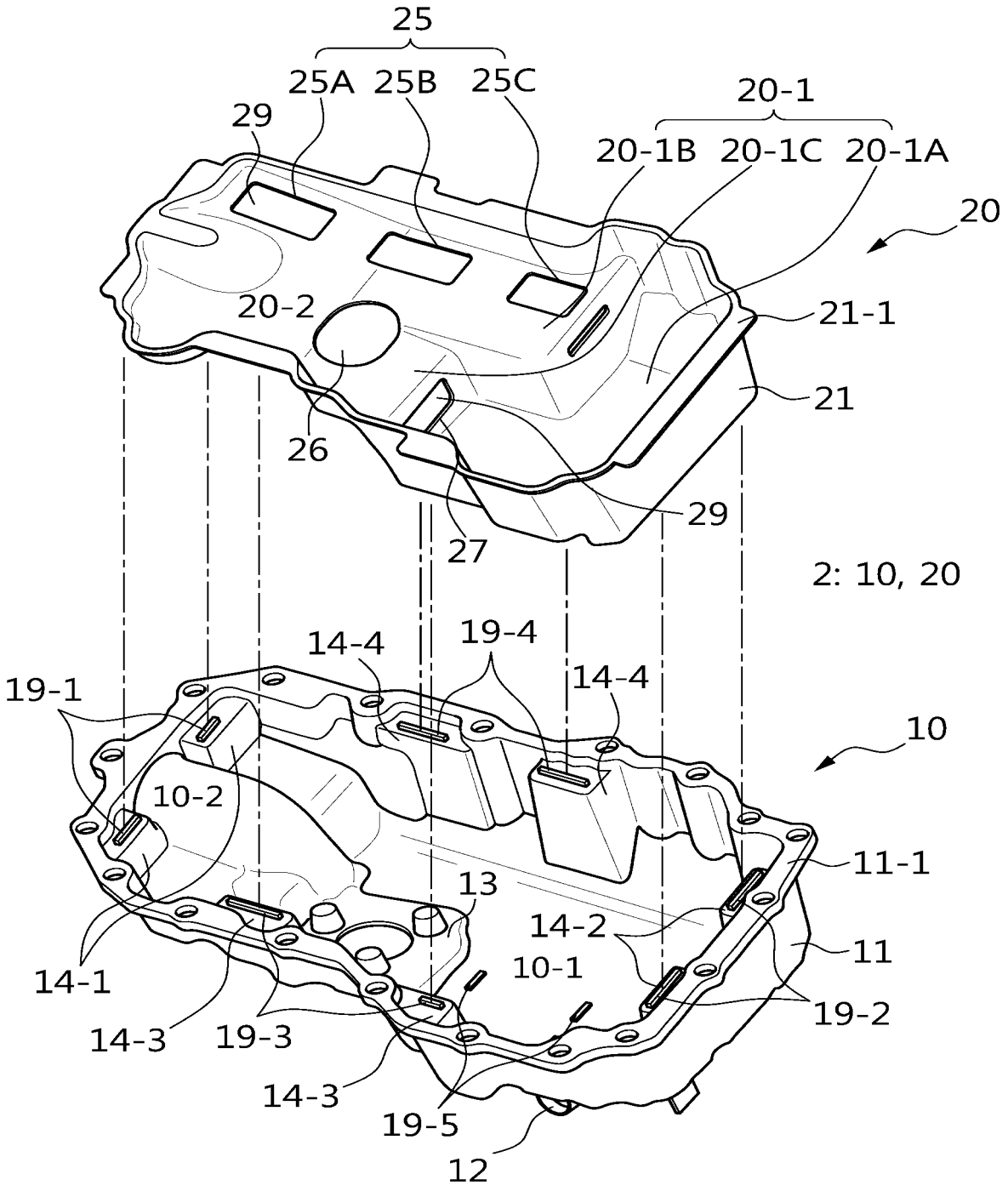
FIG. 1 is a schematic diagram of a main chamber body and a sub-chamber body which constitute a chamber body of a fast engine oil warm-up type oil pan in one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

These forms are to be considered as illustrative and not restrictive, as those skilled in the art will readily appreciate that various modifications, additions and substitutions are possible, without departing from the scope and spirit of the present disclosure as disclosed in the accompanying claims.

Figures 6A, 6B:
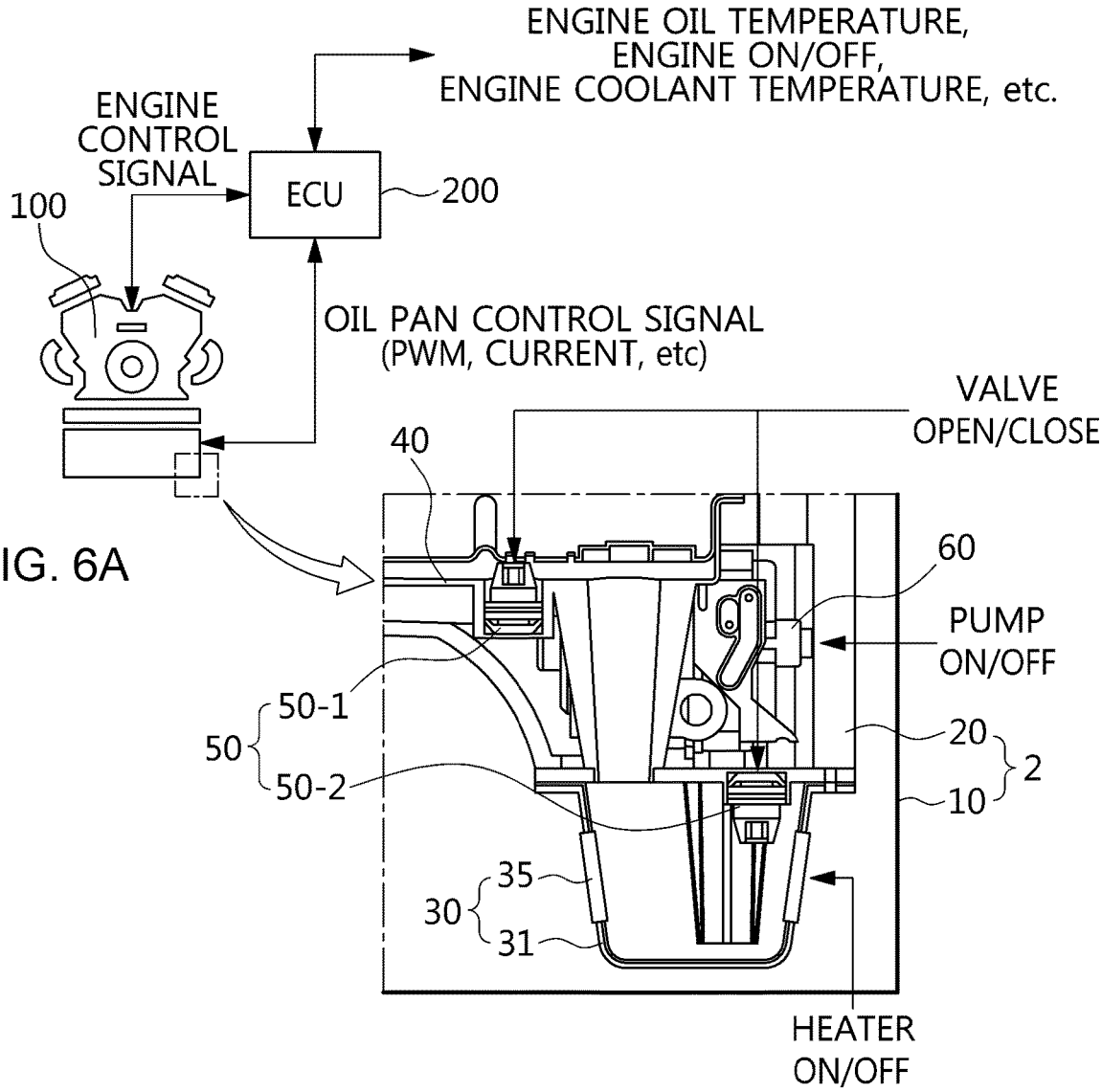
FIGS. 6A and 6B are schematic diagrams of an engine system to which a fast engine oil warm-up type oil pan is applied in one form of the present disclosure.

Referring to FIGS. 1 and 6A, an oil pan 1 may be made of plastic injection molding to be arranged below an engine 100. The oil pan 1 may be configured to a fast engine oil warm-up type oil pan 1 capable of rapidly warming-up engine oil by preheating acceleration for the engine 100 (a low temperature engine oil (for, example, room temperature compared to 60° C.~100° C.) in cold starting of the engine.

For this purpose, the oil pan 1 may include a pan body 2, a pan cover 3 and an oil pump 60.

For example, the pan body 2 and the pan cover 3 may be formed of a case shape. The pan body 2 may form a dual chamber having a main chamber case 10 and a sub-chamber case 20 in which oil is stored, respectively. In cold starting condition, only the oil of the sub-chamber case 20 is rapidly supplied to the engine 100 so that it is able to rapidly increase temperature of the oil. The pan cover 3 may be fastened to the main chamber case 10 by bolting to be integrated with the oil pan 1, and block the inner space of the dual chamber from the outside.

For example, the oil pump 60 may be arranged at one side of the sub-chamber case 20, and pumps the oil collected in an inner space thereof to form the oil circulation flow which is supplied to the engine 100.

In one form, the main chamber case 10 may be sized to accommodate the sub-chamber case 20 in an inner space of the main chamber case 10, and the pan cover 3 may be engaged to an outer main chamber rim 11-1 by bolting. Therefore, in the main chamber case 10, a part of the inner space thereof forms a primary chamber occupied by a sub-chamber case 20, and the sub-chamber case 20 forms a secondary chamber with its own shape. Particularly, the secondary chamber capacity of the sub-chamber case 20 may be designed to secure durability, function, and the oil supply safety during a vehicle is turning as well as fuel efficiency while focusing on the fast engine oil warm-up in cold starting. For example, the secondary chamber capacity of the sub-chamber case 20 may be set to 30-40% of the secondary chamber capacity of the main chamber case 10.

The main chamber case 10 may be composed of a main chamber body 11 forming the primary chamber, the main chamber rim 11-1 forming the outer rim of the main chamber body 11, a drain port 12 drilled to the bottom surface of the main chamber body 11, a sensor mounting boss 13 formed to protrude from the bottom surface of the main chamber body 11, a sub-chamber post 14 formed to protrude from the bottom surface of the main chamber body 11 along the wall surface of the primary chamber, and a sub-chamber rib 19 formed at the sub-chamber post 14.

For example, the main chamber body 11 may form the primary chamber by the inner space having the bottom surface, and the capacity of the primary chamber may be set to 60-70% of the secondary chamber of the sub-chamber case 20. The primary chamber may be composed of a main chamber 10-1 and a main extension chamber 10-2 bounding the total length of the main chamber body 11, and the main chamber 10-1 may be positioned at the space where the drain port 12 and the sensor mounting boss 13 are arranged. The main extension chamber 10-2 may be connected to the side surface of the main chamber 10-1 to form a protrusion engaged with the sub-chamber case 20. Particularly, the bottom surface of the main chamber 10-1 may be flat and the bottom surface of the main extension chamber 10-2 may be formed to be slant in order to guide the oil flow toward the main chamber 10-1.

Figure 7:
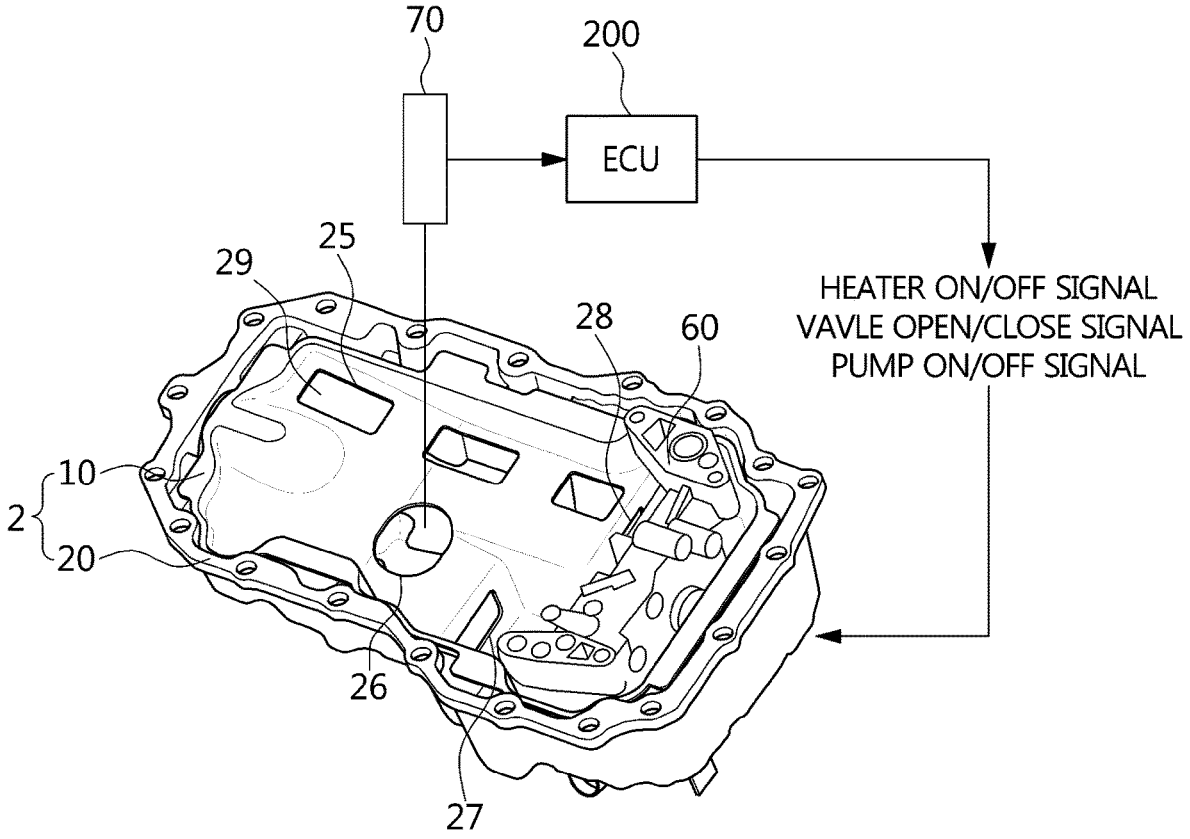
FIG. 7 is a perspective view of the chamber body from which the cover of the fast engine oil warm-up type oil pan in one form of the present disclosure is removed.

For example, the main chamber rim 11-1 may be integrally formed at the rim of the main chamber body 11 in the flange shape in which a plurality of holes are drilled for the bolting engagement. The drain port 12 drains the oil to the outside of the main chamber body 11. The sensor mounting boss 13 may form a place to which an oil level sensor 70 is fastened as shown in FIG. 7.

For example, when the total length of the main chamber body 11 is divided into the forward and backward directions and the total width thereof is divided into the left and right sides, the sub-chamber post 14 may be composed of front and rear ports 14-1 and 14-2 formed in front and rear along the total length, respectively, and left and right ports 14-3 and 14-4 formed on the left and right sides along the total width, respectively. The front post 14-1 may be formed on the wall surface of the main extension chamber 10-2 at a level lower than the rim of the main chamber body 11 and the rear post 14-2 may be formed on the wall surface of the main chamber 10-1 at a height lower than the rim of the main chamber body 11. The left post 14-3 may be formed on the wall surface of the main chamber 10-1 at a lower level than the rim of the main chamber body 11 and the right post 14-4 may be formed on the wall surface of the chamber 10-1 at a height lower than the rim of the main chamber body 11.

For example, the sub-chamber rib 19 may have a protrude shape so that a sub-chamber body 21 of the sub-chamber case 20 can be seated to be fused, and the sub-chamber rib 19 may be divided into front and rear ribs 19-1 and 19-2 and left and right ribs 19-3 and 19-4 and bottom ribs 9-5. The front and rear ribs 19-1 and 19-2 may be formed at the front and rear ports 14-1 and 14-2, respectively, and the left and right ribs 19-3 and 19-4 may be formed at the left and right ports 14-3 and 14-4, and the plurality of the bottom ribs 19-5 may be formed on the bottom surface of the main chamber body 11 in the space of the main chamber 10-1.

Concretely, the sub-chamber case 20 may composed of a sub-chamber body 21 forming the secondary chamber, a sub-chamber rim 21-1 forming an outer rim of the sub-chamber body 21, an oil drop hole 25 exhausting the oil of the secondary chamber from the sub-chamber body 21, a sensor hole 26 into which an oil level sensor 70 is inserted, an oil exchange hole 27 moving the oils of the primary and secondary chambers to each other, a safety hole 28 moving the oil of the primary and secondary chambers to each other when the oil exchange hole 27 is blocked, and a mesh 29 provided at the oil drop hole 25 and the oil exchange hole 27 to adjust the temperature of the oil exhausted to the oil drop hole 25 and the oil exchange hole 27.

For example, the sub-chamber body 21 may form the secondary chamber by the inner space having an bottom surface, and the capacity of the secondary chamber may be set to 30-40% compared to the capacity of the primary chamber of main chamber case 10. Particularly, the bottom surface of the sub-chamber body 21 may be fused to the bottom ribs 19-5. Further, the secondary chamber may be composed of a sub-chamber 20-1 and a sub-extension chamber 20-2 dividing the total length of the sub-chamber body 21, the sub-extension chamber 20-2 may be divided as a part of an inner space in which a protrude engaged with the main chamber case 10 is formed whereas the sub-chamber 20-1 is partitioned into an inner space excluding the sub-extension chamber 20-2 and forms an acute angle sub-chamber inclination coincident with the inclination angle of the main extension chamber 10-2 toward the sub-chamber 20-1.

Particularly, the sub-chamber 20-1 may be divided into a pump chamber 20-1A, a sensor chamber 20-1B and a mesh chamber 20-1C. The pump chamber 20-1A may be formed at a depth that fully accommodates the size of the oil pump 60, and each of the sensor chamber 20-1B and the mesh chamber 20-1C may be protruded lower than the outer rim of the sub-chamber body 21 on the bottom surface of the pump chamber 20-1A to be connected with the sub-extension chamber 20-2. In this case, the bottom surfaces of the pump chamber 20-1A and the mesh chamber 20-1C are flat while the mesh chamber 20-1C forms an acute angle pump chamber inclination that induces an oil flow toward the pump chamber 20-1A. Further, the sensor hole 26 may be pierced on the upper surface of the sensor chamber 20-1B while the oil exchange hole 27 communicated with the pump chamber 20-1A may be pierced on the side surface of the sensor chamber 20-1B, and the oil drop hole 25 may be pierced on the upper surface of the mesh chamber 20-1C while the safety hole 28 communicated with the pump chamber 20-1A may be pierced on the side surface of the mesh chamber 20-1C.

For example, the sub-chamber rim 21-1 may be integrally formed on the rim of the sub-chamber body 21 with a flange shape and fused with each of the front, rear, left and right ribs 19-1, 19-2, 19-3 and 19-4.

For example, the oil drop hole 25 may be composed of a first, second and third holes 25A, 25B and 25C separated from each other, and the first hole 25A may be pierced on the upper surface of the sub-extension chamber 20-2 and each of the second and third holes 25B and 25C may be pierced on the upper surface of the mesh chamber 20-1C. The sensor hole 26 may be pierced on the upper surface of the sensor chamber 20-1B. The oil exchange hole 27 may be pierced on the side surface on the sensor chamber 20-1B. The safety hole 28 may be pierced on the surface of mesh chamber 20-1C so that the oil flow passage of the primary and secondary chambers can be maintained regardless of the oil temperature when the oil exchange hole 27 is blocked. Therefore, the oil drop hole 25 and the safety hole 28 are formed at right angles to each other, and the sensor hole 26 and the oil exchange hole 27 are formed at right angles to each other. Thus, the oil exchange hole 27 is opened toward the same direction as the safety hole is opened, and the safety hole 28 and oil exchange hole 27 are spaced apart from each other.

For example, the mesh 29 may be coupled to each of the first, second and third holes 25A, 25B and 25C, and serve to discharge the oil of the secondary chamber from the sub-chamber case 20 toward the primary chamber of the main chamber case 10 depending on the oil temperature. Further, the mesh 29 may be coupled to the oil exchange hole 27, and serve to move the oil from the primary chamber to the secondary chamber or from the secondary chamber to the primary chamber depending on the oil temperature.

Particularly, the mesh 29 may be made of steel mesh so that the oil permeation amount of the mesh 29 is set to the steel mesh size. For example, the steel mesh size may set the oil temperature of 60-100° C. as a threshold value considering durability and function for oil supply stability.

Figures 2A, 2B:
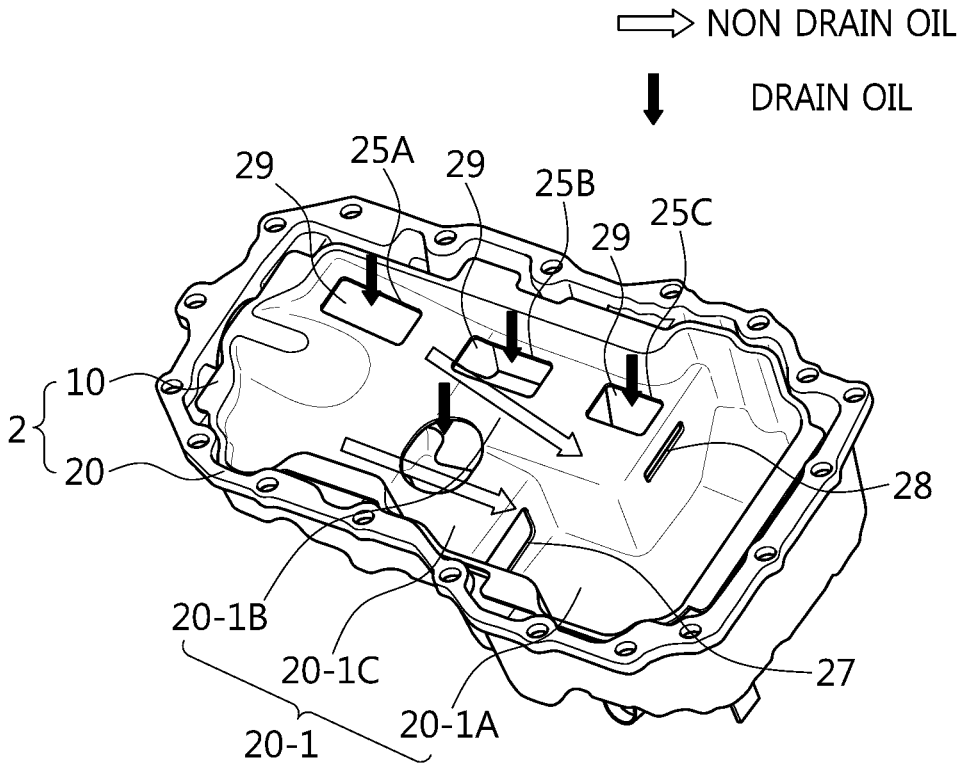
FIGS. 2A-2B show an example of the oil permeability design of a sub-chamber body by a mesh in one form of the present disclosure.

Referring to FIGS. 2A-2B, when the oil flow of 1000 ml and the mesh 29 of 150 μm are applied, the ratio of the drain flow rate (A) and non-drain flow rate (a) at the room temperature is about 1.5 times, the ratio of the drain flow rate (B) and non-drain flow rate (b) at 60° C. is about 3.0 times, the ratio of the drain flow rate (D) and non-drain flow rate (d) at 80° C. is about 4.0 times and the ratio of the drain flow rate (E) and non-drain flow rate (e) at 100° C. is increased to about 24 times.

Particularly, since the oil permeation amount of the mesh 29 may be changed by a mesh density of micrometer (μm) in the same oil condition, the steel mesh size of the mesh 29 may be determined in response to the oil permeation flow rate (for example, drain flow rate) for discharge and movement between primary and secondary chambers and the viscosity of the engine oil.

Figure 3:
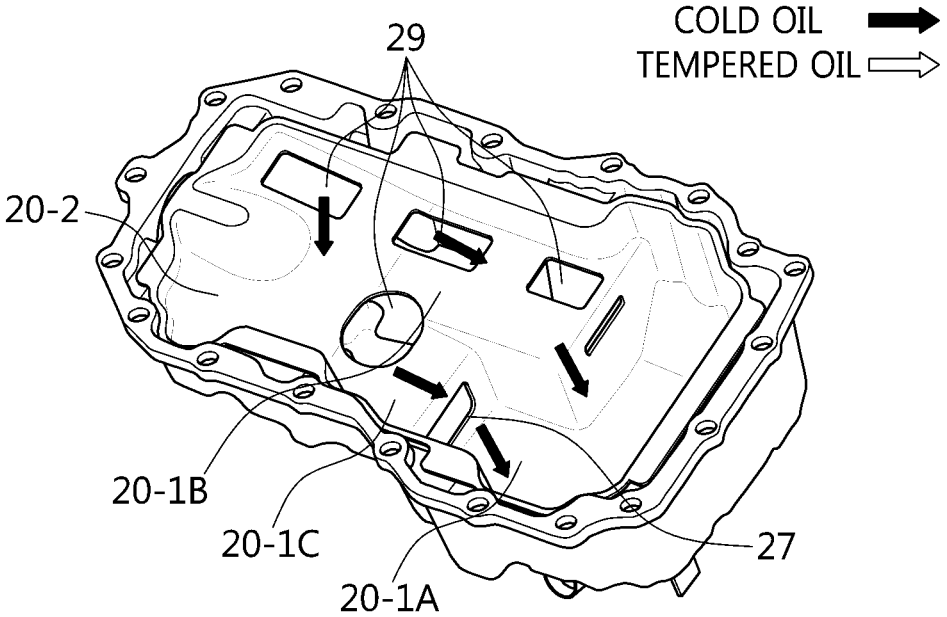
FIG. 3 shows the oil flow state in the oil pan for preheating accelerating of low temperature engine oil in cold starting of an engine in one form of the present disclosure.
Figure 4:
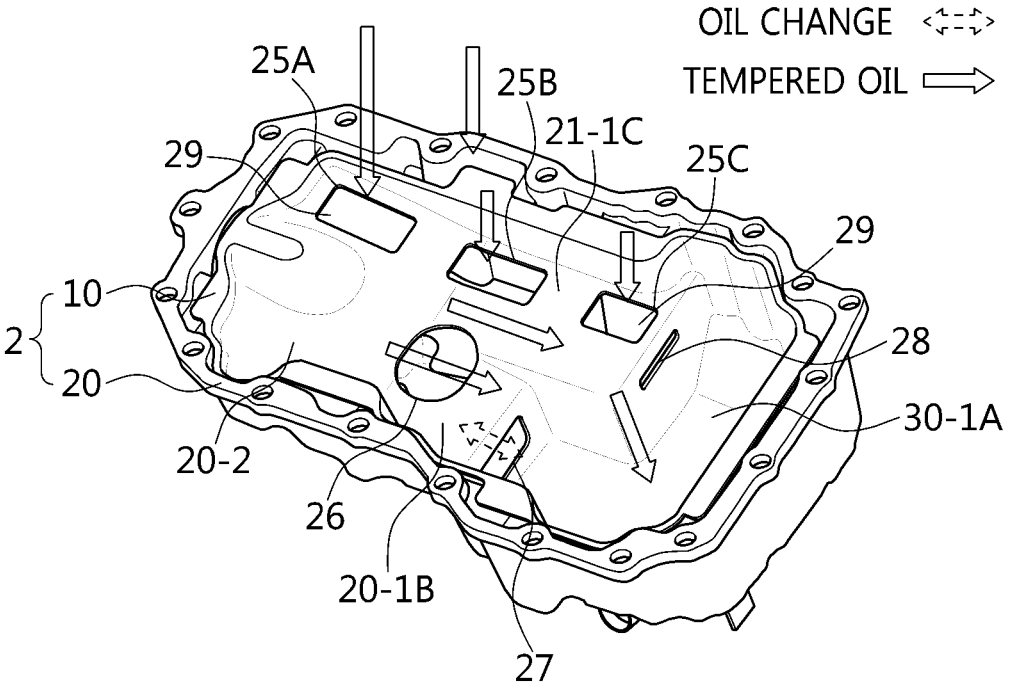
FIG. 4 shows the oil flow state of the high temperature engine oil in the oil pan in one form of the present disclosure.

Meanwhile, FIGS. 3 and 4 show oil flow by oil temperature using the primary and secondary chambers of the oil pan 1.

FIG. 3 shows the oil flow state in the oil pan 1 for fast engine oil warm-up in the cold starting condition of the engine. As shown in FIG. 3, in case of the oil temperature of room temperature in cold starting condition of the engine, the room temperature oil (cold oil) is not supplied to the primary chamber of the main chamber case 10 due to the operation of the mesh 29 coupled to the first, second and third holes 25A, 25B and 25C of the sub-chamber case 20 and the oil exchange hole 27, respectively, to stay in the secondary chamber of the sub-chamber case 20.

Therefore, when the oil pump 60 is operated during the operation of the engine by the cold starting condition, the room temperature oil (cold oil) is exhausted to the secondary chamber of the sub-chamber case 20. Then, the room temperature oil (cold oil) discharged to the secondary chamber passes through the sub-extension chamber 20-2, the sensor chamber 20-1B and the mesh chamber 20-1C to be gathered in the pump chamber 20-1A, and the room temperature oil (cold oil) gathered in the pump chamber 20-1A is discharged to the inner space thereof. As a result, the room temperature oil (cold oil) sufficiently gathered in the inner space is sent to the engine through the oil pump 60 pumping action.

Thereafter, the returned oil of the engine is converted to the tempered oil of which temperature is raised by heat exchange and then flows into again, and the tempered oil circulates again through the same process as the room temperature oil (cold oil). Then, after the tempered oil has risen to a certain temperature (e.g. 80° C.) by repeating the circulation process, the oil flow of oil pan 1 is switched to the oil flow state shown in FIG. 4.

Referring to FIG. 4, the tempered oil, which has been raised to a sufficient temperature, is passed through the first, second and third holes 25A, 25B and 25C of the sub-chamber case 20 and flows into the primary chamber of the main chamber case 10, and then, moves from the primary chamber to the secondary chamber through the oil exchange hole 27 of the sub-chamber case 20, respectively.

As a result, the pumping operation of the oil pump 60 sucks all of the tempered oil in the primary and secondary chambers so that the oil flow rate is supplied at a sufficient oil flow rate desired by the engine after the cold starting of the engine.

Figure 5:
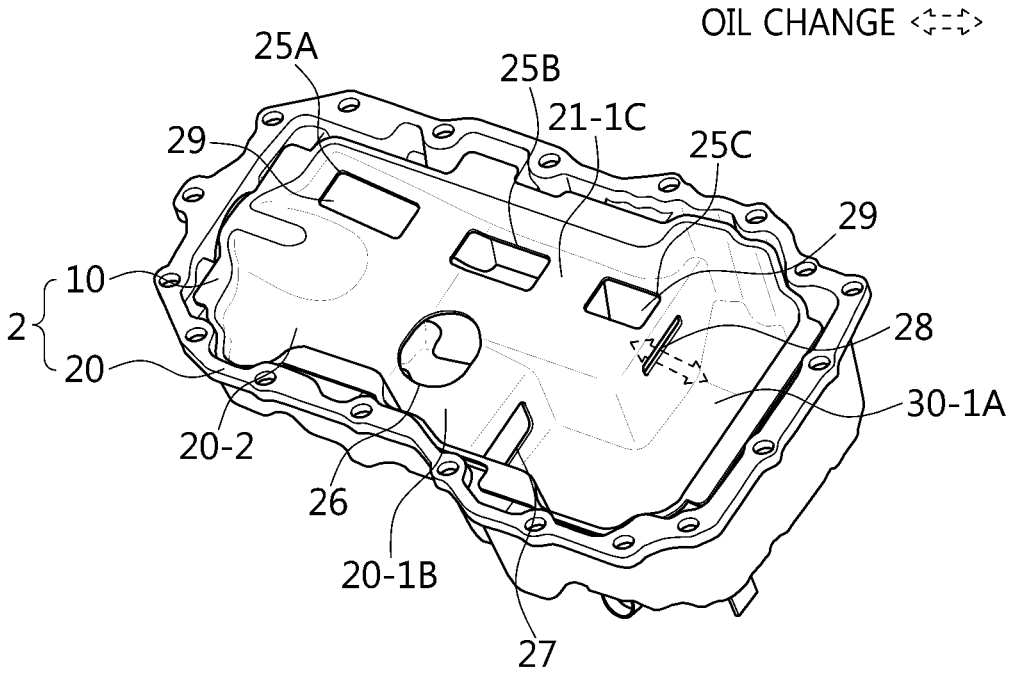
FIG. 5 shows the inter-chamber oil exchange state of the oil pan through a safety hole when the mesh is blocked in one form of the present disclosure.

On the other hand, FIG. 5 shows the oil exchange state between the primary and secondary chambers of the oil through the safety hole 28 when the mesh 29 is blocked. As shown in FIG. 5, blockage of the mesh 29 blocks the oil flow through the first, second and third holes 25A, 25B and 25C and the oil exchange hole 27, so that oil movement is formed regardless of the oil temperature with respect to the oil movement failure of the primary and secondary chambers through the oil change hole 27.

As a result, the oil pan 1 can reliably supply and circulate the engine oil to the engine.

On the other hand, FIGS. 6 to 9 show an example of engine system to which a fast engine oil warm-up type oil pan 1 is applied.

Referring to FIGS. 6A-6B and 7, the engine system may be composed of the oil pan 1, the engine 100 and an ECU 200. Particularly, the oil pan 1 may include a heater 30, an oil deflector 40 formed of a case shape, a flow rate valve 50, an oil level sensor 70 and an oil strainer (not shown). The reason for this is to avoid fuel efficiency deterioration and excessive exhaust gas generation, and so on, due to the cold starting of the engine, by realizing a fast temperature rise by adding function of the fast engine oil warm-up type oil pan 1 shown in FIG. 1 to FIG. 5 and oil heating function of the heater 30.

The engine 100 may be an internal combustion engine and in operation thereof, the oil of oil pan 1 is circulated so that the friction sliding surface of the moving system can be lubricated. The ECU 200 detects an engine oil temperature, engine ON/OFF and engine coolant temperature, and so on, and controls the engine 100 with an engine control signal and controls each operations of the engine 100, a heating element 35, an oil deflector valve 50-1, a sub-chamber valve 50-2 and the oil pump 60 with an oil pan control signal according to the operation of the engine 100. In this case, the oil pan control signal is a heater ON/OFF signal, a valve open/close signal, and an oil pump ON/OFF signal.

For example, the heater 30 heats the oil of the sub-chamber case 20 in the cold starting condition to promote oil warm-up by rapid oil temperature rise. For this, the heater 30 is located in the sub-chamber case 20 and forms the space in which the oil stored in the sub-chamber case 20 and the oil of the sub-chamber case 20 flowed into from the main chamber case 10 are gathered. To this end, the heater 30 may be composed of a heater body 31 forming an inner space and a heating body 35 built in the heater body 31 to generate heat. The heater body 31 may be integrated with the sub-chamber case 20 in an injection molded structure, or integrated with the sub-chamber case 20 through a screw or welding as a separate structure. The heating element 35 may be made of a heating conductor For example, the oil deflector 40 may be located in the inner space of the sub-chamber case 20 and exhaust the stored oil through the hollow boss located in the inner space of the heater 30.

For example, the flow rate valve 50 may be an ON/OFF type valve consisted of an oil deflector valve 50-1 and a sub-chamber valve 50-2. The oil deflector valve 50-1 may be provided in the oil deflector 40 to exhaust the oil of the oil deflector 40 to the sub-chamber case 20 when the oil deflector valve 50-1 is opened. The sub-chamber valve 50-2 may be provided in the sub-chamber case 20 and exhaust the oil in the sub-chamber case 20 to the inner space of the heater 30 when opened.

For example, the oil pump 60 may be located on one side of the sub-chamber case 20, and forms an oil circulation flow that pumps the oil collected in the inner space of the heater 30 to supply the engine 100 during operation. The oil level sensor 70 may be inserted into the sensor hole 26 of the sub-chamber case 20 and mounted on the sensor mounting boss 13 of the main chamber case 10 to detect the oil flow rate stored in the pan body 2. The oil strainer filters out impurities and foreign matter in the oil.

Figure 8A:
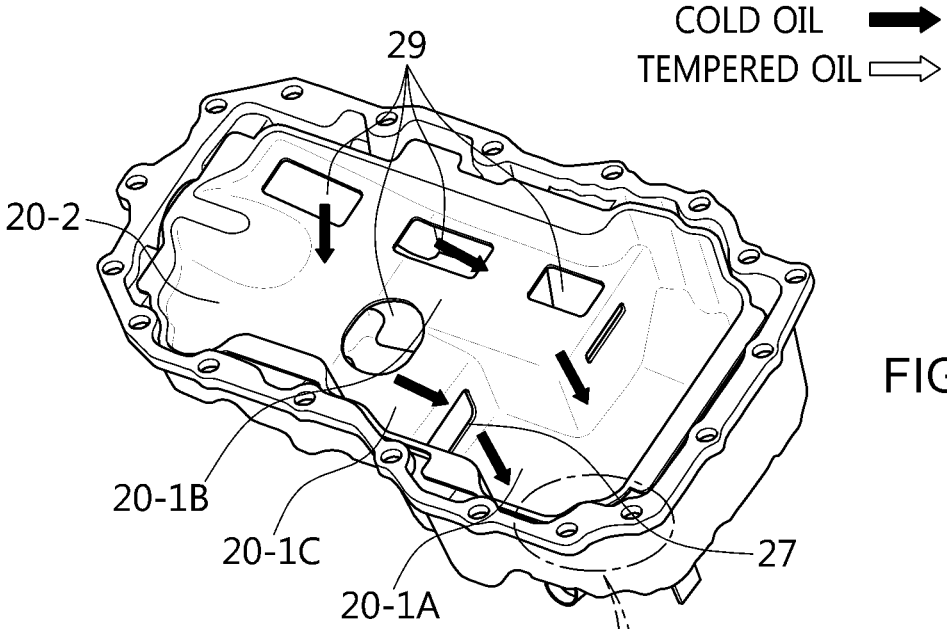
FIGS. 8A-8B show the oil flow state in the oil pan for preheating accelerating of the low temperature engine oil in cold starting of the engine in one form of the present disclosure.
Figure 8B:
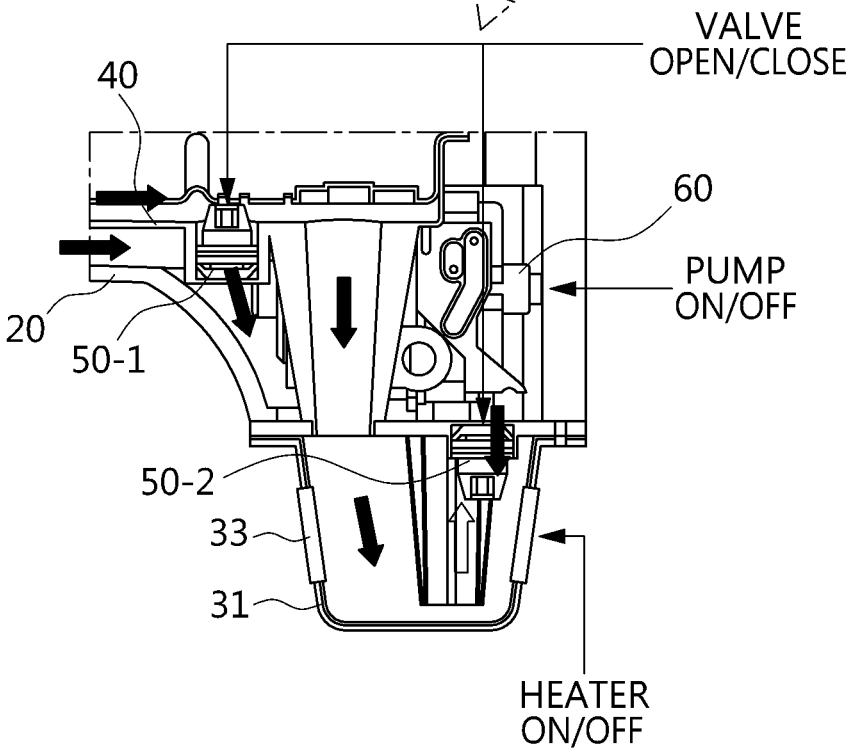

On the other hand, FIGS. 8A-8B and 9 show an example of adding the function of the heater 30 and the flow valve 50 to the oil flow by the oil temperature using the primary and secondary chambers of the oil pan 1.

FIGS. 8A-8B show the oil flow state in the oil pan 1 for fast engine oil warm-up in the cold starting condition of the engine 100.

As shown in FIGS. 8A-8B, in case of the oil temperature of room temperature in cold starting condition of the engine, the room temperature oil (cold oil) is not supplied to the primary chamber of the main chamber case 10 due to the operation of mesh 29 coupled to the first, second and third holes 25A, 25B and 25C of the sub-chamber case 20 and the oil exchange hole 27, respectively, to stay in the secondary chamber of the sub-chamber case 20.

Therefore, when the engine 100 is operated by the cold starting condition, the ECU 200 supplies the current to the heating element 33 of the heater 30 simultaneously while activating the oil pump 60 with the oil pump ON signal. At the same time, the ECU 200 opens the oil deflector valve 50-1 and the sub-chamber valve 50-2 together with the valve OPEN signal.

The room temperature oil (cold oil) is then exhausted through the hollow boss of the oil deflector 40 to the inner space of the heater 30 and exhausted to the secondary chamber of the sub-chamber case 20 through the simultaneously opened oil deflector valve 50-1. Then, the room temperature oil (cold oil) exhausted from the secondary chamber is collected in the pump chamber 20-1A through the sub-extension chamber 20-2, the sensor chamber 20-1B and the mesh chamber 20-1C, and the room temperature oil (cold oil) collected in the pump chamber 20-1A is exhausted to the inner space of the heater 30 through the opened sub-chamber valve 50-2. As a result, the room temperature oil (cold oil), which is sufficiently gathered in the interior space of the heater 30, is sent to the engine 100 at a state of temperature raised by heat generation the heating element 35 through the oil pump 60 that performs a pumping operation.

Thereafter, the returned oil of the engine 100 is converted into the tempered oil whose temperature has risen through the heat exchange and is flowed into the oil deflector 40, and the tempered oil is circulated through the same process as the room temperature oil.

After the tempered oil is raised to a certain temperature (for example, 80° C.) by repeating the circulation process, the ECU 200 sensing the tempered oil switches the oil flow of the oil pan 1 to the oil flow state shown in FIGS. 6A-6B.

Figure 9A:
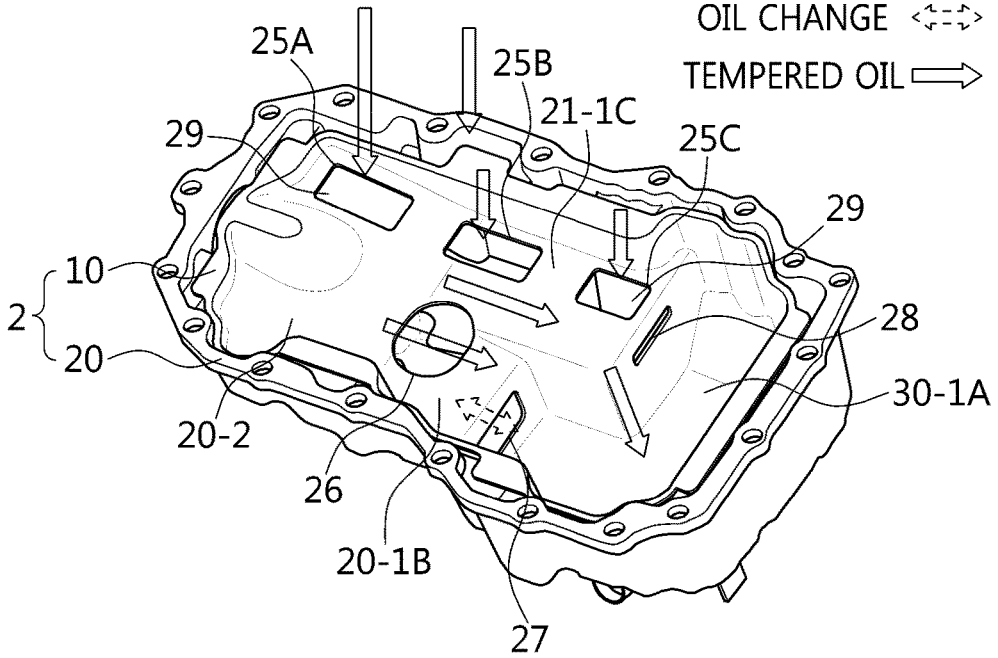
FIGS. 9A-9B show the oil flow state of the high temperature engine oil in the oil pan in one form of the present disclosure.
Figure 9B:
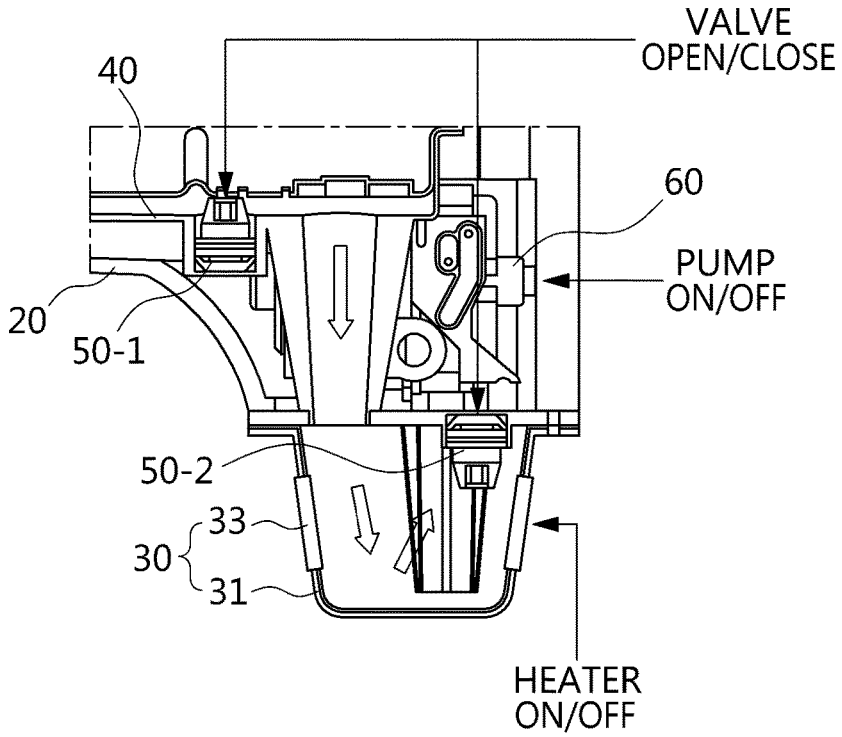

Referring to FIGS. 9A and 9B, when the tempered oil is raised to a sufficient temperature, the ECU 200 closes the oil deflector valve 50-1 and the sub-chamber valve 50-2 with the valve CLOSE signal in the operating state of the oil pump 60 by controlling the engine 100 in a cold starting condition release state. At the same time, the ECU 200 cuts off the current supply of the heating element 35 with a heater OFF signal.

Then, the tempered oil, which has been raised to a sufficient temperature, is passed through the first, second and third holes 25A, 25B and 25C of the sub-chamber case 20 and flowed into the primary chamber of the main chamber case 10, to move from the primary chamber to the secondary chamber through each of the oil exchange holes 27 of the sub-chamber case 20.

As a result, The pumping action of the oil pump 60 sucks all of the tempered oil in the primary and secondary chambers so that the oil flow rate is supplied at a sufficient oil flow rate desired by the engine 100 after the cold starting.

As described above, the engine system according to the present exemplary form includes the fast oil warm-up type oil pan 1 converting the oil gathered in the secondary chamber to the tempered oil by heating at an oil temperature of the low oil permeation amount to mesh 29 provided in the secondary chamber among the primary and secondary chambers partitioned in the pan body 2, so that it is possible to rapidly warm-up the engine oil through pre-heating acceleration oil flow rate division by the dual chambers, and particularly, and particularly, it is able to increase warming effects by the heat loss reduction depending on the pre-heating acceleration and improve application by engine specification through high design freedom together.

The exemplary form as discussed previously is merely a desirable form which may enable a person (hereinafter referred to as 'a skilled person in the relevant technology'), who has a typical knowledge in a technology field that the present disclosure belongs to, to execute the present disclosure easily, but the present disclosure is not limited to the aforesaid exemplary form and the attached drawings, and hence this does not result in limiting the scope of right in this present disclosure. Therefore, it will be apparent to a skilled person in the relevant technology that several transposition, transformation, and change is possible within a scope of not deviating from the technological thought in the present disclosure and it is obvious that a easily changeable part by a skilled person in the relevant technology is included within the scope of right in the present disclosure as well.

What is claimed is:

1. An oil pan comprising:

a pan body including a main chamber case configured to form a primary chamber and a sub-chamber case configured to form a secondary chamber, wherein the primary chamber and the secondary chamber are configured to contain a different amount of oil, respectively; and a mesh configured to differentiate an amount of oil permeation discharged from the secondary chamber to the primary chamber based on temperature of the oil, wherein:

an oil drop hole, an oil exchange hole and a safety hole are formed on the sub-chamber case, and the safety hole is pierced on a side surface of the sub-chamber case while the oil drop hole is pierced on an upper surface of the sub-chamber case.

2. The oil pan of claim 1, wherein the pan body is made of plastic.

3. The oil pan of claim 1, wherein the oil temperature at which the amount of oil permeation is low is a cold starting condition of an engine to which the oil is supplied.

4. The oil pan of claim 1, wherein a capacity of the secondary chamber is in a range of from 30% to 40% compared to a capacity of the primary chamber.

5. The oil pan of claim 1, wherein the mesh is provided on a bottom surface of the secondary chamber.

6. The oil pan of claim 5, wherein the mesh is steel mesh and is configured to adjust the amount of oil permeation by a mesh density of micrometer (μm).

7. The oil pan of claim 1, wherein:

the sub-chamber case is coupled to the main chamber case.

8. The oil pan of claim 7, wherein the main chamber case is coupled with the sub-chamber case by fusing the sub-chamber case to sub-chamber ribs formed at the main chamber case.

9. The oil pan of claim 7, wherein:

the mesh is coupled to each of the oil drop hole and the oil exchange hole.

10. The oil pan of claim 9, wherein the oil drop hole comprises a plurality of oil drop holes spaced apart from each other.

11. The oil pan of claim 9, wherein the oil drop hole and the oil exchange hole are arranged at right angles to each other.

12. The oil pan of claim 1, wherein:

the safety hole is opened toward the same direction as the oil exchange hole is opened, and the safety hole and oil exchange hole are spaced apart from each other.

13. The oil pan of claim 1, wherein an oil pump for pumping the oil is accommodated into the pan body.

14. The oil pan of claim 1, wherein a pan cover is coupled to the pan body to block external exposure of the primary chamber and the secondary chamber.

15. The oil pan of claim 14, wherein the body and the pan cover is coupled to each other by bolting.

16. An engine system comprising: the oil pan of claim 1.

17. The engine system of claim 16, wherein the oil pan is made of plastic and located at a lower portion of an engine.

* * * * *